US008282747B2

(12) United States Patent
Oda

(10) Patent No.: US 8,282,747 B2
(45) Date of Patent: Oct. 9, 2012

(54) COOLING METHOD OF STEEL PLATE

(75) Inventor: Tomoya Oda, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/223,367

(22) PCT Filed: Jul. 31, 2007

(86) PCT No.: PCT/JP2007/065320
§ 371 (c)(1),
(2), (4) Date: Jul. 28, 2008

(87) PCT Pub. No.: WO2008/020549
PCT Pub. Date: Feb. 21, 2008

(65) Prior Publication Data

US 2009/0194207 A1 Aug. 6, 2009

(30) Foreign Application Priority Data

Aug. 18, 2006 (JP) ..... 2006-223636

(51) Int. Cl.
*C21D 6/00* (2006.01)

(52) U.S. Cl. ..... 148/661; 148/644; 148/664

(58) Field of Classification Search ..... 72/201; 148/644, 660–661, 664; 266/259
See application file for complete search history.

(56) References Cited

U.S. PATENT DOCUMENTS 4,596,615 A * 6/1986 Matsuzaki et al. ..... 148/503
4,723,562 A 2/1988 Wilmotte et al. ..... 134/122

FOREIGN PATENT DOCUMENTS

EP 0 178 281 4/1986
GB 806786 12/1958

(Continued)

OTHER PUBLICATIONS

International Search Report dated Nov. 6, 2007 issued in corresponding PCT Application No. PCT/JP2007/065320.

(Continued)

*Primary Examiner* — Stanley Silverman
*Assistant Examiner* — Brian Walck
(74) *Attorney, Agent, or Firm* — Kenyon & Kenyon LLP

(57) ABSTRACT

A cooling method of steel plate able to raise a cooling uniformity in a steel plate conveyance direction comprising, at a front stage part of a cooling apparatus, not spraying while a front end region of steel plate is passing, spraying by successively increasing the cooling water rate from 80 to 95 vol % ($Q_{front}$) of a standard water density when the front part region passes so that the amount of cooling water becomes the standard water density when a boundary part of the front part region and a center part region arrives, and continuing spraying by the standard water density while the center part region is passing, then, at a rear stage part of the cooling apparatus, spraying by making the amount of cooling water 80 to 95 vol % of the standard water density while the front end region of the steel plate is passing, successively increasing the amount of cooling water rate from 80 to 95 vol % of the standard water density when the front part region passes so that the amount of cooling water becomes the standard water density when the boundary part of the front part region and the center part region arrives, and continuing spraying by the standard water density while the center part region is passing.

2 Claims, 4 Drawing Sheets

FOREIGN PATENT DOCUMENTS

| | | |
|---|---|---|
| JP | 60-43435 | 3/1985 |
| JP | 60-043435 | 3/1985 |
| JP | 60-068107 | 4/1985 |
| JP | 62-127116 | 6/1987 |
| JP | 62-130222 | 6/1987 |
| JP | 63-013610 | 1/1988 |
| JP | 7-185631 | 7/1995 |
| JP | 08-309425 | 11/1996 |
| JP | 2006-192489 | 7/2006 |

OTHER PUBLICATIONS

Supplementary European Search Report dated Jul. 30, 2008 issued in corresponding European Application No. 07 79 1993.
Clark et al., "MULPIC Plate Cooling Technology", Rolling and Processing, vol. 7 (2005).
Clark et al., "MULPIC Plate Cooling Technology", Rolling and Processing Chronicle (2005).
Evans, "Innovative Solutions for Quality Plate Production", Rolling and Processing, Jul. 2005.
Champion et al., "Cooling Technology for Modem Plate Grade", VAI Plate Mills Symposium, Presentation, 2005.
Champion et al., "Cooling Technology for Modern Plate Grade", VAI Plate Mills Symposium, Abstract, 2005.
Streisselberger et al., "Extended application of TM plates due to new process development", HSLA Steels' 95, 1995.
Dilg et al., "TMCP Process including two accelerated cooling stages," La Revue de Metallurgie-CIT, 1995.
Anonymous, "Accelerate cooling of plate by water-air spraying", Steel Times, p. 617-618, 623, 1991.
Notice of Opposition filed by Siemens VAI Metals Technologies Ltd. in European Patent No. 1925373, dated Dec. 23, 2010.
Notice of Opposition filed by Centre de Recherches Megallurgiques asb1 in European Patent No. 1925373, dated Dec. 23, 2010.
Clark, "MULPIC Plate Cooling Technology," Siemens VAI UK, 2005, pp. 20-23.
"MULPIC system: Accelerated Controlled Cooling and Direct Quench for Plate Mills," Siemens VAI, 2006.

* cited by examiner

COOLING METHOD OF STEEL PLATE

BACKGROUND OF THE INVENTION

1. Field of the Invention

The present invention relates to a cooling method of a steel plate, more particularly relates to a cooling method of a hot rolled steel plate.

2. Description of the Related Art

The process of continuously cooling hot rolled steel plate by a cooling apparatus and controlling the structure of the steel plate to produce thick-gauge steel plate having high strength and high toughness is widely used. This production process contributes to reduction of the production costs by the reduction of alloying elements and to the improvement of the welding work efficiency.

However, in this process of production, the temperatures of the front end part and the rear end part of the steel plate become lower in comparison with the center part of the steel plate in the length direction before the steel plate is transferred to the cooling apparatus. In addition, in water spray cooling in a cooling apparatus as well, there are large influences of heat transfer and heat conduction from the end surfaces, therefore an overcooling phenomenon occurs and the flatness and material properties easily become unstable.

For this reason, for example, as disclosed in Japanese Patent Publication (A) No. 60-43435, there is a proposed a method for tracking a steel plate position and masking the front end part and the rear end part of the steel plate by stopping the spray of the cooling water so as to prevent overcooling at the front end part and the rear end part.

The overcooling prevention effect on the front end part and the rear end part of steel plate by the masking method shown in the above Japanese Patent Publication (A) No. 60-43435 is great. However, this is ON/OFF control, that is, the masked parts are not sprayed with water, while the part which is not masked (also referred to as the "non-masked part") is supplied with cooling water of the standard water density, therefore the amount of water sharply changes at the boundary parts. In particular, a large temperature difference occurs at the front end part of the steel plate.

For this reason, a difference in material quality occurs in the steel plate conveyance direction (also referred to as the "steel plate longitudinal direction") inviting a drop in yield. The shape of the front end region is also easily degraded in comparison with the center part in the steel plate conveyance direction due to the influence of the temperature difference.

SUMMARY OF THE INVENTION

An object of the present invention is to provide a novel and improved cooling method of steel plate able to raise the cooling uniformity in the steel plate conveyance direction.

The present invention was made to solve the above problems and has as its gist the following:

(1) A cooling method of steel plate which cools hot rolled steel plate, while conveying it in one direction, by supplying cooling water from nozzles arranged at the top and bottom in a cooling apparatus, the cooling method of steel plate characterized by:

dividing the steel plate into a front end region, a front part region, and a center region from a head side in the conveyance direction of the steel plate and dividing the cooling apparatus into a front stage part and a rear stage part in the conveyance direction of the steel plate, at the front stage part of the cooling apparatus, not spraying any cooling water while the front end region of the steel plate is passing, spraying by successively increasing the amount of cooling water from 80 to 95 vol % of a standard water density when the front part region passes so that the amount of cooling water becomes the standard water density when a boundary part of the front part region and the center part region arrives, continuing spraying by the standard water density while the center part region is passing, then, at the rear stage part of the cooling apparatus, spraying by making the amount of cooling water 80 to 95 vol % of the standard water density while the front end region of the steel plate is passing, successively increasing the amount of cooling water rate from 80 to 95 vol % of the standard water density when the front part region passes so that the amount of cooling water becomes the standard water density when the boundary part of the front part region and the center part region arrives, and continuing spraying by the standard water density while the center part region is passing.

(2) A cooling method of a steel plate as set forth in (1), further comprising dividing the tail end side of the above steel plate from the center part region into a rear part region and a rear end region in the conveyance direction of the steel plate and successively reducing the amount of cooling water from the standard water density at the front stage part and rear stage part of the cooling apparatus when the center part region of the steel plate finishes passing through and the rear part region is passing so as to spray an amount of cooling water becoming 80 to 95 vol % of the standard water density when the boundary part of the rear part region and the rear end region is reached and spray an amount becoming 80 to 95 vol % of the standard water density when the rear end region is passing.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Figure 1:
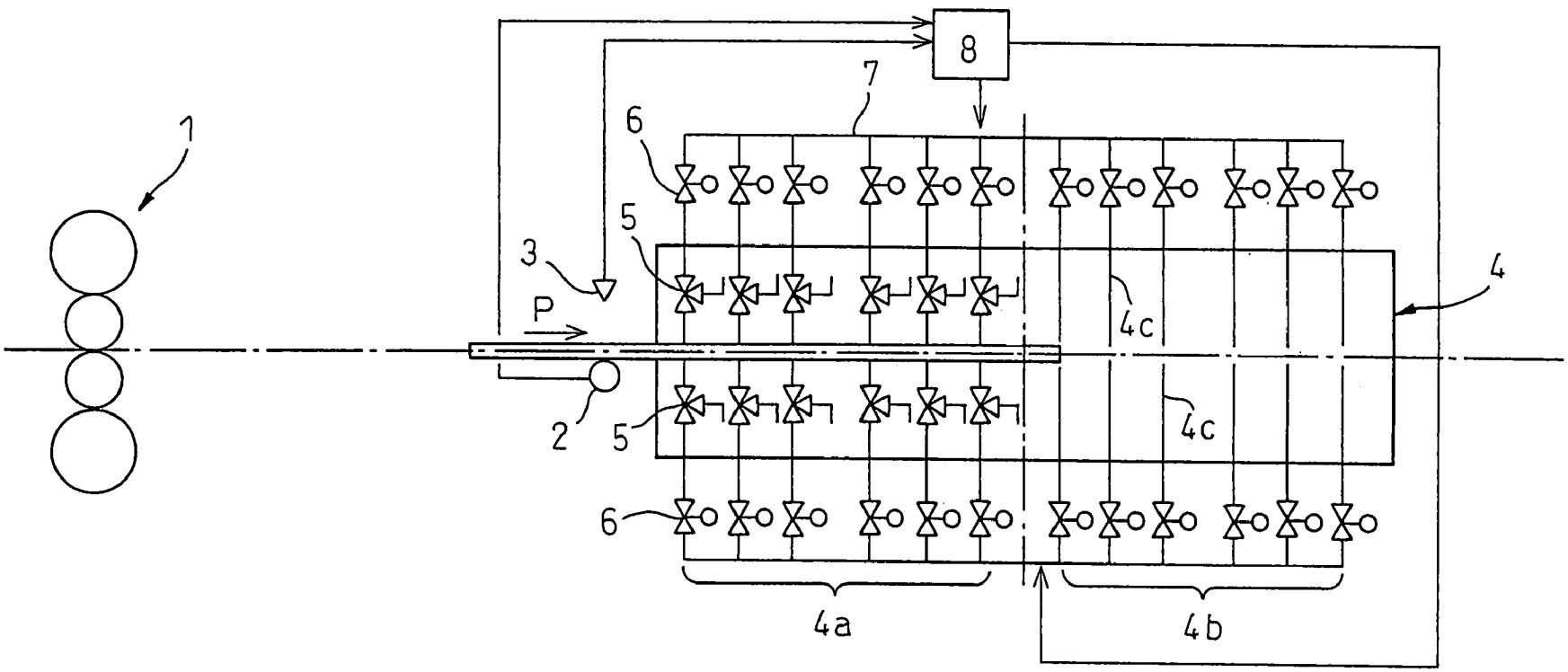
FIG. 1 is a schematic diagram showing a cooling apparatus according to a first embodiment of the present invention.

The present invention was made to solve the above problem. The means (1) characterizing it is a cooling method of steel plate which cools hot rolled steel plate, while conveying it in one direction, by supplying cooling water from nozzles arranged at the top and bottom in a cooling apparatus, the cooling method of steel plate characterized by dividing the steel plate into a front end region, a front part region, and a center region from a head side in the conveyance direction of the steel plate and dividing the cooling apparatus into a front stage part and a rear stage part in the conveyance direction of the steel plate; at the front stage part of the cooling apparatus, not spraying any cooling water while the front end region of the steel plate is passing, spraying by successively increasing the amount of cooling water from 80 to 95 vol % of a standard water density when the front part region passes so that the amount of cooling water becomes the standard water density when a boundary part of the front part region and the center part region arrives, continuing spraying by the standard water density while the center part region is passing, then; at the rear stage part of the cooling apparatus, spraying by making the amount of cooling water 80 to 95 vol % of the standard water density while the front end region of the steel plate is passing, successively increasing the amount of cooling water rate from 80 to 95 vol % of the standard water density when the front part region passes so that the amount of cooling water becomes the standard water density when the boundary part of the front part region and the center part region arrives, and continuing spraying by the standard water density while the center part region is passing.

By such a constitution, a large temperature drop at the boundary parts of the masked front end region of the thick-gauge steel plate in the steel plate length direction and the front part region of the non-masked part can be suppressed. Further, the difference of the temperature distribution in the steel plate length direction is reduced, therefore it becomes possible to make shapes of the front and region and the front part region of the steel plate better and becomes possible to suppress changes in the material properties in the steel plate conveyance direction.

It is also possible to divide the tail end side of the above steel plate from the center part region into a rear part region and a rear end region in the conveyance direction of the steel plate and successively reduce the amount of cooling water from the standard water density at the front stage part and rear stage part of the cooling apparatus when the center part region of the steel plate finishes passing through and the rear part region is passing so as to spray an amount of cooling water becoming 80 to 95 vol % of the standard water density when the boundary part of the rear part region and the rear end region is reached and spray an amount becoming 80 to 95 vol % of the standard water density when the rear end region is passing. By such a constitution, it becomes possible to further improve the steel plate shape and material quality also at the rear part of the thick-gauge steel plate.

According to the present invention, the cooling uniformity in the steel plate conveyance direction can be improved.

Below, preferred embodiments of the present invention will be explained in further detail with reference to the attached drawings. Note that in the present specification and drawings, components having substantially the same functions and constitutions are assigned the same notations and overlapping explanations are omitted.

The inventors conducted various experiments and studies on the method of forced cooling hot rolled thick-gauge steel plate is divided by cooling water suppress the temperature drop at the boundary part of the masked part and the non-masked part at the front part of the thick-gauge steel plate since that temperature drop is large (about 1.5 times the rear part), where the cooling apparatus into a front stage region and a rear stage region and the front end part and rear end part of the thick-gauge steel plate are masked by ON/OFF control of the cooling water by three-way valves.

In order to suppress this temperature drop at the boundary part, it is necessary to set a flow rate adjustment valve able to adjust the flow rate in piping for supplying the cooling water to cooling nozzles in the cooling apparatus and successively increase the amount of cooling water at the boundary part. However, the region of the temperature drop at the boundary part is a short 2 to 3 meters or less, and the valve opening time of a flow rate adjustment valve (time from fully closed to fully open) is about 10 seconds even at the fastest. In addition, the steel plate conveyance speed (1.0 to 2.0 m/s) can not be reduced.

For this reason, as described above, if successively increasing the opening of the flow rate adjustment valve from fully closed to fully open, the timing when the flow rate adjustment valve becomes fully open greatly overshoots the temperature drop region and becomes the center part side of the steel plate in the conveyance direction. The new problem arises that the temperature rises at the front region of the center part where the temperature had been sound (region with no temperature drop).

Further, the present inventors proceeded with detailed investigations, experiments, and studies and consequently discovered that the temperature drop of the boundary part described above is almost always 15 to 30° C. or so and that even if not successively increasing the opening degree of the flow rate adjustment valve from fully closed to fully open, if successively opening the valve from the opening degree giving 80 to 95 vol % of the standard water density (amount of water per unit area and unit time supplied to center part of steel plate (unit: $m^3(m^2 \cdot min)$) $Q_0$ (hereinafter this water density referred to as $Q_{front}$) so as to set the standard water density $Q_0$, it is possible to suppress the temperature drop of the above boundary part to an extent causing no problem in actual operation without any accompanying rise in temperature of the above sound part.

Note that the standard water density $Q_0$ is for example preferably made a range from 0.3 to 1.5 $m^3/(m^2 \cdot min)$ in the case of thick-gauge steel plate. Namely, in thick-gauge steel plate using a water density where this standard water density $Q_0$ is for example more than 1.5 $m^3/(m^2 \cdot min)$, the temperature at the time of the end of cooling is low in many cases and the surface temperature of the thick-gauge steel plate during cooling also becomes low. For this reason, when cooling such thick-gauge steel plate, the cooling mostly becomes cooling in the nucleate boiling region where the cooling becomes stable, therefore the temperature difference after cooling rarely becomes large, there is almost never any adverse influence due to the temperature difference. The frequency of use in the present invention is therefore low. On the other hand, with a water density where the standard water density $Q_0$ is for example less than 0.3 $m^3/(m^2 \cdot min)$, the cooling rate becomes low, therefore coarsening of the grain of the thick-gauge steel plate can be prevented, but the strength of the thick-gauge steel plate cannot be improved, so the frequency of use of a water density of less than 0.3 $m^3/(m^2 \cdot min)$ is low. Therefore, the applicability of the present invention is low.

Note that the standard water density $Q_0$ is mainly determined by the quality of the cooled steel plate. Other than this, it is determined by the temperature difference between the temperature of the steel plate before the cooling by the cooling apparatus and the target temperature of the steel plate after cooling, the heat conductivity of the steel plate, the cooling nozzles and other cooling forms and various other factors. Further, the temperature of the steel plate before cooling fluctuates according to the time for the steel plate to travel from the heating furnace, pass through the rolling mill, and reach the cooling apparatus, the rolling method, and other factors.

Figure 2:
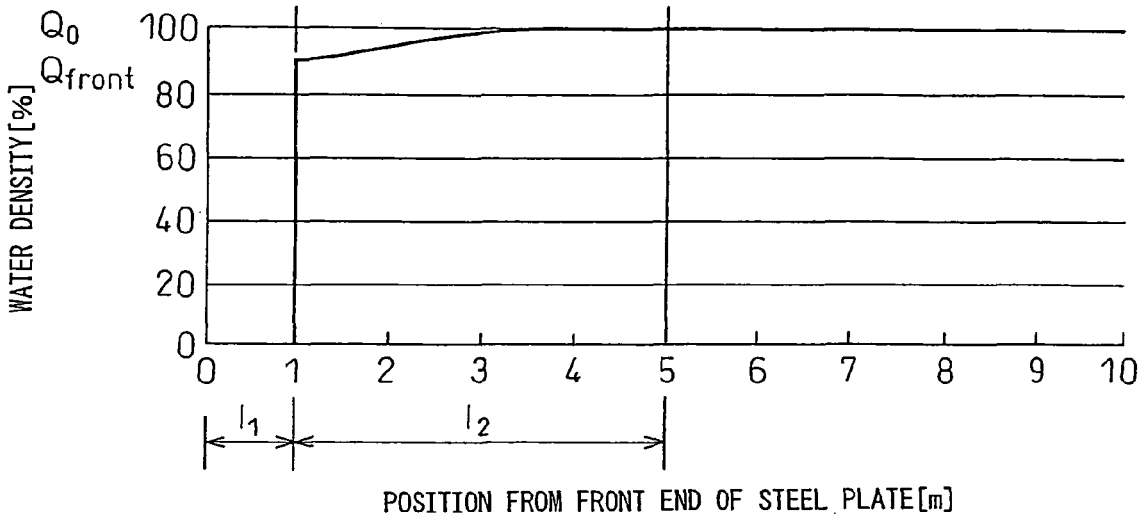
FIG. 2 is an explanatory view showing a water density distribution in a steel plate length direction at a front stage region 4*a* of the cooling apparatus according to the embodiment.
Figure 3:
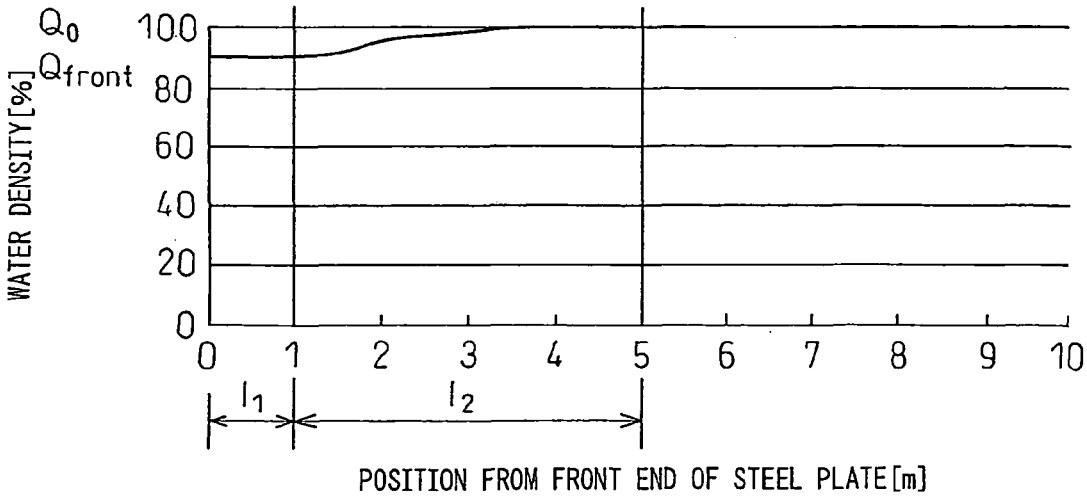
FIG. 3 is an explanatory view showing a water density distribution in a steel plate length direction at a rear stage region of the cooling apparatus according to the embodiment.
Figure 4:
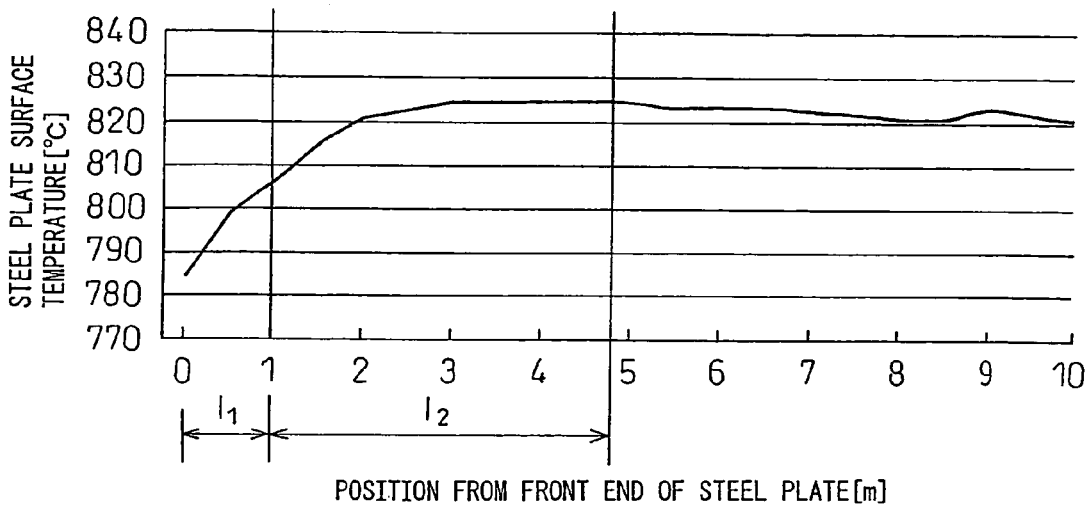
FIG. 4 is an explanatory view showing a surface temperature distribution of steel plate in the steel plate length direction according to the embodiment.
Figure 5:
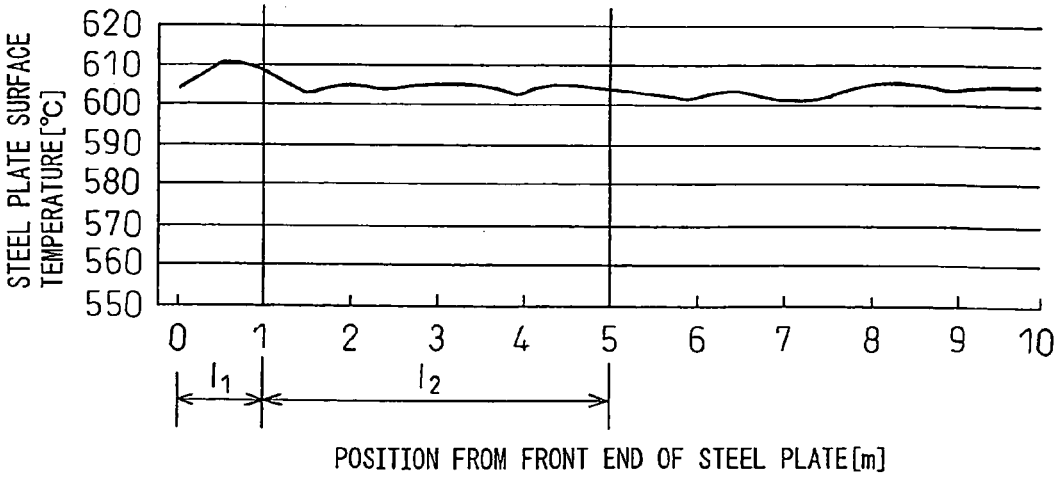
FIG. 5 is an explanatory diagram showing the surface temperature distribution of steel plate at an exit side of the cooling apparatus according to the same embodiment.

The present invention was made based on these findings and is explained in detail with reference to FIG. 1 to FIG. 5. FIG. 1 is a schematic diagram showing a cooling apparatus for carrying out the cooling method according to a first embodiment of the present invention. FIG. 2 is an explanatory view showing a water density distribution in the steel plate length direction at a front stage region of the cooling apparatus according to the present embodiment. FIG. 3 is an explanatory view showing a water density distribution in the steel plate length direction at a rear stage region of the cooling apparatus according to the present invention. FIG. 4 is an explanatory view showing a surface temperature distribution of the steel plate in the steel plate length direction according to the present embodiment. FIG. 5 is an explanatory view showing a surface temperature distribution of the steel plate on an exit side of the cooling apparatus according to the present embodiment.

As shown in FIG. 1, adjoining the cooling apparatus 4 according to the present embodiment, a thick-gauge steel plate rolling mill 1 is disposed. The cooling apparatus 4 is provided with a measuring roll 2, a steel plate position detection sensor 3, cooling nozzles 4*c*, three-way valves 5, flow rate adjustment valves 6, a header pipe 7, and a control unit 8. The cooling apparatus 4 is divided into a front stage region 4*a* and a rear stage region 4*b*. In order for the cooling nozzles to spray cooling water on the top surface and the bottom surface of steel plate P to be cooled, pluralities of cooling nozzles 4*c* are provided in a length direction and a width direction of the steel plate P. Further, the cooling nozzles 4*c* are provided at the front ends of pipes branched from the header pipe 7. In the middle of the pipes, the three-way valves 5 and the flow rate adjustment valves 6 are provided at the front stage region 4*a*, and the flow rate adjustment valves 6 are provided at the rear stage region 4*b*. The control unit 8 tracks the position of the steel plate P based on the detection information of the measuring roll 2 and the steel plate position detection sensor 3 and adjusts and controls the opening degrees of the three-way valves 5 and the flow rate adjustment valves 6 by this tracking information.

Further, the steel plate P to be cooled is divided for convenience into three regions: a front end region (region up to for example 0.5 to 2 meters from the front end of the steel plate toward the center part side in the steel plate length direction) $I_1$, a front part region (region up to for example 4 to 10 meters from the boundary part of the front end region and the front part region toward the center part side in the steel plate length direction) $I_2$, and a center part region (center part side region in the steel plate length direction over the boundary part of the front part region and the center part region), and the cooling water rates supplied from the cooling apparatus 4 are adjusted and controlled. The ranges of these three regions are determined according to for example the relationship between a response speed of the flow rate adjustment valves 6 and the conveyance speed of the steel plate and cooling conditions such as the water density and the temperature of the steel plate at the time of the end of the cooling. Further, they are determined by the temperature distribution of the steel plate before cooling. Further, the temperature distribution of this steel plate before cooling fluctuates due to the time for the steel plate to travel from the heating furnace, pass through the rolling mill, and reach the cooling apparatus, the rolling method, the heat conductivity of the steel plate, the material quality, and other factors.

In the present embodiment, first, when the steel plate P to be cooled passing through the rolling mill 1 and finished being hot rolled moves on a path line toward the cooling apparatus 4, the front end of the steel plate P is detected by the steel plate position detection sensor 3. Then, the detection information of the front end of the steel plate P is input to the control unit 8. Next, the measuring roll 2 finds the movement distance of the steel plate P and inputs the movement distance to the control unit 8. Using these two input information, the control unit 8 tracks the position of the steel plate P during conveyance.

Next, the control of the flow rate timing valves 6 and three-way valves 5 by the control unit 8 will be explained. First, before the front end of the steel plate P enters the cooling apparatus 4, the opening degrees of the flow rate adjustment valves 6 are throttled back so that the water density becomes $Q_{front}$ at the front stage region 4*a* and rear stage region 4*b* of the cooling apparatus 4. Further, the flow rate adjustment valves 6 and three-way valves 5 are controlled so as to open the three-way valves 5 at the front stage region 4*a* to an off-line side (the side out of path line of the steel plate P). Due to this, cooling water having the water density $Q_{front}$ is discharged to the off-line side at the front stage region 4*a* and is sprayed from the cooling nozzles 4*c* at the rear stage region 4*b*.

In this state, the front end of the steel plate P enters the cooling apparatus 4, and the steel plate P successively passes between top/bottom cooling nozzles 4*c*. At this time, at the front stage region 4*a* of the cooling apparatus 4, the three-way valves 5 at all of the cooling nozzles 4*c* are successively switched to the on-line side when the front end region $I_1$, of the steel plate P passes the cooling nozzle 4*c* positions (the positions where the cooling nozzles 4*c* are provided) and the front part region $I_2$ of the steel plate P reaches the cooling nozzle 4*c* positions so as to thereby successively start the spray of the cooling water to the steel plate P from the cooling nozzles 4*c* provided in the steel plate length direction. Then, from immediately after that to when the front part region $I_2$ of the steel plate P has passed the cooling nozzle 4*c* positions, the opening degrees of the flow rate adjustment valves 6 are successively increased to make them fully open immediately before the front part region $I_2$ of the steel plate P passes. Due to this, the cooling water density of the water sprayed from the cooling nozzles 4*c* in the front stage region 4*a* successively increases from $Q_{front}$ and reaches the standard water density $Q_0$.

On the other hand, at the rear stage region 4*b* of the cooling apparatus 4, the steel plate P starts to be cooled by the entry of the front end of the steel plate P into the water sprayed from the cooling nozzles 4*c* with the cooling water density $Q_{front}$. Then, when the front part region $I_2$ of the steel plate P reaches the positions of the cooling nozzles 4*c*, the opening degrees of the flow rate adjustment valves 6 similarly successively start to increase and become fully open immediately before the front part region $I_2$ passes.

Figure 6:
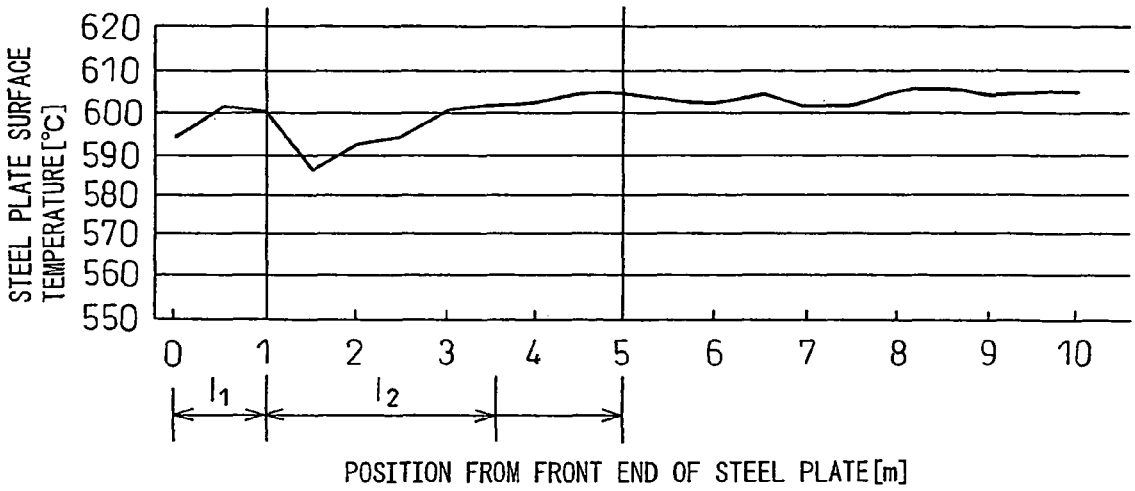
FIG. 6 is an explanatory diagram showing the surface temperature distribution of steel plate at an exit side of a conventional cooling apparatus.

Due to such a cooling method, for example, when the front part of the thick-gauge steel plate P has the temperature shown in FIG. 4, the water density of the cooling water sprayed from the cooling nozzles 4*c* at the front stage region 4*a* of the cooling apparatus 4 becomes as shown in FIG. 2, while the water density of the cooling water sprayed from the cooling nozzles 4*c* at the rear stage region 4*b* of the cooling apparatus 4 becomes as shown in FIG. 3. As a result of this, the temperature of the steel plate P exiting the cooling apparatus 4 exhibits a good temperature distribution as shown in FIG. 5. On the other hand, when only controlling masking to stop the spray of water at the front end region without using the present invention, the temperature difference at the boundary of the front end region and the front part region is large as shown in FIG. 6. Note that FIG. 6 is an explanatory view showing the surface temperature distribution of steel plate at the exit side of the conventional cooling apparatus.

Next, the method of cooling the rear part of the thick-gauge steel plate P according to the present embodiment will be explained. The temperature drop of the boundary of the masked part and non-masked part at the rear part of the thick-gauge steel plate P is smaller in comparison with the front part described above, but it is preferable to prevent this temperature drop too. This will be explained below.

The steel plate P to be cooled is divided, for convenience, into three regions: a rear end region (region from the rear end of the steel plate toward the center part side in the steel plate length direction), rear part region (region from the rear end region toward the center part side in the steel plate length direction), and the center part region. The amounts of cooling water supplied from the cooling apparatus 4 are adjusted and controlled. The ranges of these three regions are determined according to for example the relationship between the response speed of the flow rate adjustment valves 6 and the conveyance speed of the steel plate, the water density, the temperature of the steel plate at the time of the end of the cooling, and other cooling conditions. Further, they are also determined according to the temperature distribution of the steel plate before the cooling. The temperature distribution of this steel plate before the cooling fluctuates due to the time for the steel plate to travel from the heating furnace, pass through the rolling mill, and reach the cooling apparatus, the rolling method, the heat conductivity, quality, etc. of the steel plate, and other factors.

The rear part of this thick-gauge steel plate P passes through the cooling apparatus 4 in the order of the center part region, rear part region, and rear end region, so while the center part region of the thick-gauge steel plate P is passing through the front stage region 4*a* of the cooling apparatus 4, it is sprayed and cooled by the standard water density $Q_0$, but when the rear part region of the thick-gauge steel plate P reaches the cooling nozzle 4*c* positions, the opening degrees of the flow rate adjustment valves 6 provided at the cooling nozzles 4*c* are successively throttled so that the water density becomes $Q_{front}$ described above before the rear end region arrives. Then, when the rear end region reaches the cooling nozzle 4*c* positions, the three-way valves 5 are switched to the off-line side, the cooling water is discharged to the off-line side, and the spray of cooling water to the rear end region is stopped. This operation is successively performed along with movement to the rear part of the thick-gauge steel plate P for the cooling nozzles 4*c* from the entry side of the cooling apparatus 4 to the exit side direction. Further, while the center part region of the thick-gauge steel plate P is passing the rear stage region 4*b* of the cooling apparatus 4, it is sprayed and cooled by the standard water density $Q_0$ in the same way as described above, but when the rear part region of the thick-gauge steel plate P reaches beneath the cooling nozzles 4*c*, the opening degrees of the flow rate adjustment valves 6 provided at the cooling nozzles 4*c* are successively throttled so that the water density becomes $Q_{front}$ described above before the rear end region arrives. Then, after that, the rear end region is sprayed and cooled in the state where those opening degrees are maintained.

EXAMPLES

Examples of the present invention will be explained together with comparative examples with reference to Table 1 and Table 2. Table 1 is a table showing the plate thicknesses, plate widths, plate lengths, and temperature distributions of thick-gauge steel plates 1 to 3 before passing through the cooling apparatus. Table 2 is a table showing water densities and temperature distributions of thick-gauge steel plates after cooling of Examples 1 to 3 and Comparative Examples 1 and 2 in a case where thick-gauge steel plates 1 to 3 shown in Table 1 are cooled by the cooling apparatus while conveying these at a speed of 60 m/min.

TABLE 1

| | | Thick-gauge steel plate 1 | Thick-gauge steel plate 2 | Thick-gauge steel plate 3 |
|---|---|---|---|---|
| Plate thickness [mm] | | 20 | 20 | 20 |
| Plate width [mm] | | 3032 | 2988 | 3010 |
| Plate length [mm] | | 29542 | 30462 | 29872 |
| Front end region | Maximum value [° C.] | 808 | 809 | 810 |
| | Minimum value [° C.] | 790 | 793 | 790 |
| Front part region | Maximum value [° C.] | 825 | 827 | 825 |
| | Minimum value [° C.] | 815 | 816 | 813 |
| Center part region | Maximum value [° C.] | 824 | 825 | 822 |
| | Minimum value [° C.] | 819 | 816 | 819 |
| Rear part region | Maximum value [° C.] | 818 | 816 | 818 |
| | Minimum value [° C.] | 798 | 788 | 790 |
| Rear end region | Maximum value [° C.] | 786 | 789 | 790 |
| | Minimum value [° C.] | 775 | 759 | 762 |

TABLE 2

| | | | Ex. 1 | Ex. 2 | Ex. 3 | Comp. Ex. 1 | Comp. Ex. 2 |
|---|---|---|---|---|---|---|---|
| Thick-gauge steel plate No | | | 1 | 2 | 3 | 2 | 3 |
| Water rate density [$m^3/(m^2 \cdot .min)$] | Front end region | Cooling apparatus front stage | 0 | 0 | 0 | 0 | 0 |
| | | Cooling apparatus rear stage | 0.54 | 0.49 | 0.57 | 0.582 | 0.45 |
| | Front part region | Cooling apparatus front stage | 0.54 → 0.6 | 0.49 → 0.6 | 0.57 → 0.6 | 0.582 → 0.6 | 0.45 → 0.6 |
| | | Cooling apparatus rear stage | 0.54 → 0.6 | 0.49 → 0.6 | 0.57 → 0.6 | 0.582 → 0.6 | 0.45 → 0.6 |
| | | (wt %) | (90%→100%) | (82%→100%) | (95%→100%) | (97%→100%) | (75%→100%) |
| | Center part region | Cooling apparatus front stage | 0.6 | 0.6 | 0.6 | 0.6 | 0.6 |
| | | Cooling apparatus rear stage | 0.6 | 0.6 | 0.6 | 0.6 | 0.6 |
| | Rear part region | Cooling apparatus front stage | 0.6 | 0.6 → 0.49 | 0.6 → 0.57 | 0.6 → 0.582 | 0.6 → 0.45 |
| | | Cooling apparatus rear stage | 0.6 | 0.6 → 0.49 | 0.6 → 0.57 | 0.6 → 0.582 | 0.6 → 0.45 |
| | | (wt %) | 100% | (100%→82%) | (100%→95%) | (100%→97%) | (100%→75%) |
| | Rear end region | Cooling apparatus front stage | 0 | 0 | 0 | 0 | 0 |
| | | Cooling apparatus rear stage | 0.6 | 0.49 | 0.57 | 0.582 | 0.45 |
| Temp. after cooling [° C.] | Front end region | Maximum value | 611 | 621 | 604 | 601 | 630 |
| | | Minimum value | 604 | 617 | 599 | 594 | 620 |
| | Front part region | Maximum value | 605 | 620 | 610 | 604 | 623 |
| | | Minimum value | 603 | 606 | 590 | 579 | 607 |

TABLE 2-continued

| | | Ex. 1 | Ex. 2 | Ex. 3 | Comp. Ex. 1 | Comp. Ex. 2 |
|---|---|---|---|---|---|---|
| Center part region | Maximum value | 606 | 606 | 606 | 606 | 606 |
| | Minimum value | 601 | 601 | 601 | 601 | 601 |
| Rear part region | Maximum value | 615 | 611 | 603 | 602 | 624 |
| | Minimum value | 602 | 607 | 595 | 588 | 618 |
| Rear end region | Maximum value | 621 | 613 | 600 | 598 | 620 |
| | Minimum value | 604 | 610 | 593 | 591 | 615 |
| Maximum temperature difference [° C.] | | 17 | 20 | 20 | 27 | 29 |

In the examples of the present invention, a cooling apparatus arranging cooling nozzles 4*c* in 24 lines in the steel plate conveyance direction (steel plate length direction) and arranging 70 cooling nozzles 4*c* in a direction at a right angle to the steel plate conveyance direction (steel plate width direction) is employed. Further, the front stage region 4*a* is made up to the 12th line of the cooling nozzles 4*c*, while the rear stage region 4*b* is made from that up to the 24th line. Further, the three-way valves, flow rate control valves, control units, etc. were given the same constitutions as those of FIG. 1. Further, the front end region $I_1$, of the steel plate was made 1 meter from the front end of the steel plate, the front part region $I_2$ was made 4 meters from the boundary part of the front end region $I_1$ and the front part region $I_2$, and the center part region was made the part after the boundary part of the front part region $I_2$ and the center part region.

Example 1 of this Table 2 is an example of a case where the present invention is not applied at the rear part region and the rear end region of the thick-gauge steel plate 1, but they are cooled with the standard water density, Examples 2 and 3 are examples where the present invention is applied to the front part region, the front end region, the rear part region, and the rear end region. Further, the water density $Q_{front}$ of the front stage zone when the front part region starts passing through the cooling apparatus is made, 90 vol % of the standard water density $Q_0$ in Example 1, 82 vol % in Example 2, and 95 vol % in Example 3, the water density of the rear stage zone when the rear part region finishes passing through the cooling apparatus is made 82 vol % of the standard water density $Q_0$ in Example 2 and 95 vol % in Example 3 or within a range from 80 to 95 vol %. Examples 1 to 3 are examples of applying the present invention.

In Examples 1 to 3, as shown in the row of the maximum temperature difference of Table 2, the maximum temperature difference, representing the difference of the minimum value and the maximum value of the temperature distribution of the steel plate after cooling, became a small 20° C. or less in all examples. On the other hand, Comparative Example 1 is an example of a case where the water rate densities of cooling water at the front part region and the rear part region of the steel plate at the front stage and rear stage of the cooling apparatus are over the upper limit of the present invention (97 vol %), and Comparative Example 2 is an example of a case where they are below the lower limit of the water density of the present invention (75 vol %). In both cases, the maximum temperature difference of the steel plate after cooling became much larger in comparison with Examples 1 to 3 (27° C. in Comparative Example 1 and 29° C. in Comparative Example 2). Also, the shapes of the steel plates after the cooling were degraded.

As explained above, according to the present invention, a large temperature drop of the boundary part of the masked front end region of the thick-gauge steel plate in the steel plate length direction and the front part region of the non-masked part can be suppressed, it becomes possible to make the shapes of the steel plate front end region and front part region better, and it becomes possible to suppress the change of the material quality in the steel plate length direction. Further, at the rear part of the steel plate, it becomes possible to further make the steel plate shape and material quality better. Summarizing the above, according to the present invention, the cooling uniformity in the steel plate conveyance direction is raised, and it is possible to make the material quality uniform and improve the steel plate flatness.

Above, preferred embodiments of the present invention were explained with reference to the attached drawings, but needless to say the present invention is not limited to these examples. It is clear to those skilled in the art that various modifications or corrections may be conceived of within the scope of the claims. It is understood that these also naturally are included in the technical scope of the invention.

The invention claimed is:

1. A cooling method of steel plate which cools a hot rolled steel plate, while conveying it in one direction, by supplying cooling water from nozzles arranged at the top and bottom in a cooling apparatus, said cooling method of steel plate characterized by:

dividing said steel plate into a front end region, a front part region, and a center part region from a head side in the conveyance direction of said steel plate and dividing said cooling apparatus into a front stage part and a rear stage part in the conveyance direction of said steel plate, at said front stage part of said cooling apparatus, not spraying any cooling water while said front end region of said steel plate is passing, spraying by successively increasing amount of cooling water from 80 to 95 vol % of a standard water density when said front part region passes so that said amount of cooling water becomes said standard water density when the boundary of said front part region and said center part region arrives, wherein said standard water density is the amount of water per unit area and unit time sprayed to the center part region of the steel plate;

continuing spraying by said standard water density while the center part region is passing, and, at said rear stage part of said cooling apparatus, spraying by an amount of cooling water of 80 to 95 vol % of the standard water density while said front end region of said steel plate is passing, successively increasing amount of cooling water from 80 to 95 vol % of said standard water density when said front part region passes so that said amount of cooling water becomes said standard water density when the boundary of said front part region and said center part region arrives, continuing spraying by said standard water density while the center part region is passing, and wherein said front end region is a region of 0.5 to 2 meters from head side of the steel plate towards center part side in said steel plate length direction, said front part region is a region of 4 to 10 meters from the boundary of the front end region and the front part region towards center part side in said steel plate length direction, and said center part region is a center part side region in the steel plate length direction from the boundary of the front part region and the center part region.

2. A cooling method of a steel plate as set forth in claim 1, further comprising:

dividing the tail end side of the steel plate after the center part region into a rear part region and a rear end region in the conveyance direction of the steel plate, successively reducing the amount of cooling water from the standard water density at the front stage part of the cooling apparatus when the center part region of the steel plate finishes passing through and the rear part region is passing so as to spray an amount of cooling water of 80 to 95 vol % of the standard water density when the boundary of the rear part region and the rear end region arrives and not spraying any cooling water when the rear end region is passing, and reducing the amount of cooling water from the standard water density at the rear stage part of the cooling apparatus when the center part region of the steel plate finishes passing through and the rear part region is passing so as to spray an amount of cooling water of 80 to 95 vol % of the standard water density when the boundary of the rear part region and the rear end region arrives and spraying an amount of 80 to 95 vol % of the standard water density when the rear end region is passing.

* * * * *

UNITED STATES PATENT AND TRADEMARK OFFICE

CERTIFICATE OF CORRECTION

PATENT NO. : 8,282,747 B2
APPLICATION NO. : 12/223367
DATED : October 9, 2012
INVENTOR(S) : Tomoya Oda It is certified that error appears in the above-identified patent and that said Letters Patent is hereby corrected as shown below:

In the Specification

Column 1, line 28, change "a proposed a method" to -- a proposed method --;

Column 6, line 31, change "$I_1$," to -- $I_1$ --;

Column 9, line 23, change "$I_1$," to -- $I_1$ --.

Signed and Sealed this
Tenth Day of December, 2013

Margaret A. Focarino

Margaret A. Focarino
*Commissioner for Patents of the United States Patent and Trademark Office*